US008388379B2

(12) United States Patent
Sasaki et al.

(10) Patent No.: US 8,388,379 B2
(45) Date of Patent: Mar. 5, 2013

(54) SHIELD CASE, CONNECTOR HAVING THE SHIELD CASE, AND ELECTRONIC EQUIPMENT HAVING THE CONNECTOR

(75) Inventors: Daisuke Sasaki, Yao (JP); Takayuki Nagata, Yao (JP)

(73) Assignee: Hosiden Corporation, Yao-shi (JP)

( * ) Notice: Subject to any disclaimer, the term of this patent is extended or adjusted under 35 U.S.C. 154(b) by 0 days.

(21) Appl. No.: 13/204,871

(22) Filed: Aug. 8, 2011

(65) Prior Publication Data

US 2012/0071030 A1 Mar. 22, 2012

(30) Foreign Application Priority Data

Sep. 22, 2010 (JP) ..... 2010-212637

(51) Int. Cl.
*H01R 13/648* (2006.01)

(52) U.S. Cl. ..... 439/607.35

(58) Field of Classification Search .. 439/607.35–607.4, 439/607.54, 607.55
See application file for complete search history.

(56) References Cited

U.S. PATENT DOCUMENTS 7,086,902 B1 * 8/2006 Yang ..... 439/607.36

FOREIGN PATENT DOCUMENTS

JP 3158913 4/2010

* cited by examiner

*Primary Examiner* — Ross Gushi
(74) *Attorney, Agent, or Firm* — Kratz, Quintos & Hanson, LLP

(57) ABSTRACT

The invention provides a shield case a pair of inner walls, being opposed to each other and adapted to receive a mating connector there between, the pair of inner walls each including first and second ends in an insertion direction of the mating connector; a pair of elastic contact pieces, each formed by cutting and inwardly raising a portion of each of the inner walls; openings or notches, formed in order to cut and raise the elastic contact pieces in the inner walls; a pair of folded-back portions, provided continuously to the first ends of the inner walls and folded back to a second end side of the inner walls; and a pair of outer walls, provided continuously to the folded-back portions, arranged along outer surfaces of the inner walls, and covering the openings or the notches.

14 Claims, 8 Drawing Sheets

SHIELD CASE, CONNECTOR HAVING THE SHIELD CASE, AND ELECTRONIC EQUIPMENT HAVING THE CONNECTOR

The present application claims priority under 35 U.S.C. §119 of Japanese Patent Application No. 2010-212637 filed on Sep. 22, 2010, the disclosure of which is expressly incorporated by reference herein in its entity.

BACKGROUND OF THE INVENTION

1. Technical Field

The present invention relates to shield cases, connectors using the same, and electronic equipment including the connectors.

2. Background Art

A conventional receptacle connector of this type has a tuboid shield case, a body accommodated in a back portion of the shield case, and a plurality of contacts arrayed in the body. Portions on the near side of the shield case and a surface on the near side of the body define a receiving hole for receiving a plug connector. The shield case has a pair of side walls opposed to each other, and a pair of elastic contact pieces provided in the side walls and elastically contactable with a plug connector received in the receiving hole, and a pair of connecting legs extended downward from the side walls to be connected to a circuit board by soldering (refer to Patent Literature 1).

CITATION LIST

Patent Literature 1: Japanese Utility Model Registration No. 3158913

SUMMARY OF INVENTION

In the above receptacle connector, the elastic contact pieces are formed by cutting and raising portions of the side walls, leaving openings or notches around the elastic contact pieces of the side walls. The receptacle connector would thus suffer from decrease in the strength of the shield case (especially decrease in the prying resistance when receiving a plug connector), and the shield case would exhibit unfavorable electromagnetic interference (EMI) characteristics.

The present invention has been devised in view of the above circumstances. The invention provides a shield case having elastic contact pieces, with sufficient strength and improved EMI characteristics (i.e. favorably reduced EMI). The invention also provides a connector and electronic equipment including the shield case.

A shield case according to the present invention includes a pair of inner walls, being opposed to each other and adapted to receive a mating connector therebetween, the pair of inner walls each including first and second ends in an insertion direction of the mating connector; a pair of elastic contact pieces, each formed by cutting and inwardly raising a portion of each of the inner walls; openings or notches, formed in order to cut and raise the elastic contact pieces in the inner walls; a pair of folded-back portions, provided continuously to the first ends of the inner walls and folded back to a second end side of the inner walls; and a pair of outer walls, provided continuously to the folded-back portions, arranged along outer surfaces of the inner walls, and covering the openings or the notches.

According to this aspect of the invention, as the outer walls are arranged along the outer surfaces of the inner walls, the outer walls can reinforce the inner walls, so that the strength of the shield case can be maintained. In addition, as the outer walls cover the openings or the notches of the inner walls, EMI characteristics of the shield case will be improved (i.e. EMI will be reduced).

The shield case may further include first and second coupling portions. In this case, each of the inner walls may further include a third end, extending at an angle to the first and second ends; each of the outer walls may have a first end and a second end that are opposite each other, the first end facing the third end of each of the inner walls; the first coupling portion may join the third ends of the inner walls; the second coupling portion may join the second ends of the outer walls. In this case at least the inner walls, the first coupling portion, and the second coupling portion may define an accommodating space. According to this aspect of the invention, as the third ends of the inner walls are coupled by the first coupling portion and the second ends of the outer walls are coupled by the second coupling portion, the shield case can be improved in strength.

Moreover, each of the inner walls may further include a fourth end on an opposite side of the third end. In this case, the second coupling portion may couple the fourth ends of the inner walls, in place of coupling the second ends of the outer walls. This aspect of the invention can also improve the strength of the shield case because the third ends of the inner walls are coupled by the first coupling portion and the fourth ends of the inner walls are coupled by the second coupling portion, the can be increased.

The shield case may further include a pair of first connecting legs provided on a near side in the insertion direction of the outer walls. According to this aspect of the invention, as the first connecting legs are provided in the outer walls, the shield case can ensure sufficient strength and favorable EMI characteristics, as compared with a case where the first connecting legs are formed by cutting and raising portions of the inner walls, the first coupling portion, or the second coupling portion.

The shield case may further include a pair of second connecting legs provided on a far side in the insertion direction of the outer walls. According to this aspect of the invention, as the second connecting legs are provided in the outer walls, the shield case can ensure sufficient strength and favorable EMI characteristics, as compared with a case where the second connecting legs are formed by cutting and raising portions of the inner walls, the first coupling portion, or the second coupling portion. Moreover, the shield case, connected to the circuit board at the first and second connecting legs, should exhibit improved peeling strength with respect to the circuit board.

The shield case may be a lock piece, provided in at least one of the first and second coupling portions, and adapted to lock a mating connector received in the accommodating space. According to this aspect of the invention, the mating connector locked by the lock piece will be stably connected. As a result, the invention can enhance the connection reliability of a connector using the shield case.

A connector of the present invention includes the above-described shield case; an insulating body accommodated in the accommodating space of the shield case; and a plurality of contacts arrayed in the body.

The contacts may each include a tail portion disposed on the far side in the insertion direction of the shield case. In this case, a distance between the second connecting legs may be smaller than a distance between the first connecting legs. According to this aspect of the invention, as the distance between the second connecting legs is smaller than the distance between the first connecting legs, the second connecting legs are disposed in the vicinity of the tail portions arranged on the far side in the insertion direction of the shield case. This allows the second connecting legs and the tail portions of the contacts to be soldered at neighboring positions to the circuit board, alleviating loads applied to the solder connecting the tail portions even when the mating connecter received in the accommodating space is twisted. In addition, as the second connecting legs are soldered to the circuit board on the inner side of the first connecting legs, the shield case itself is improved in peeling strength with the circuit board.

DESCRIPTION OF EMBODIMENTS

Figure 1A:
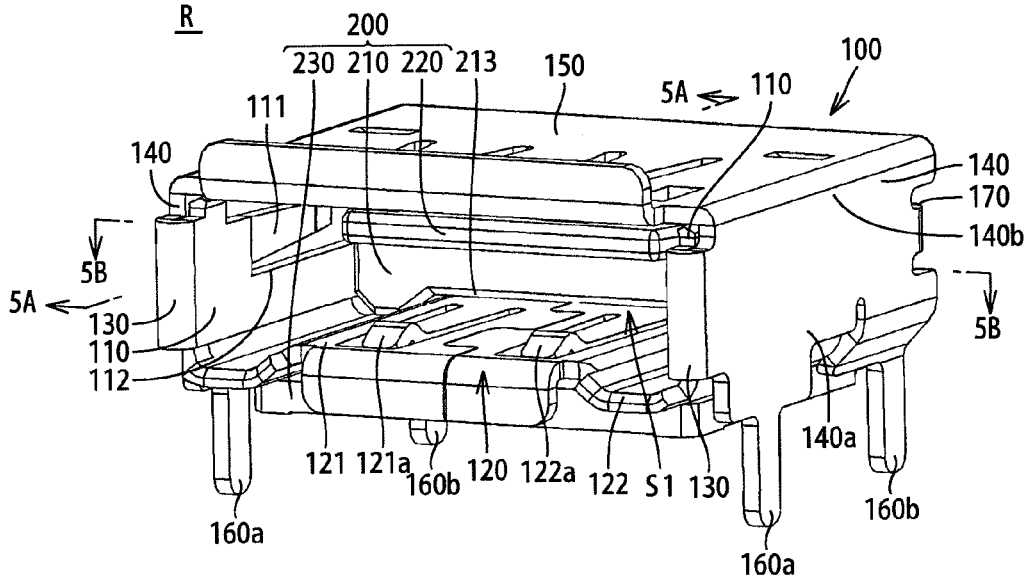
FIG. 1A is a front, plan, and right side perspective view of a receptacle connector according to an embodiment of the present invention.

A receptacle connector according to an embodiment of the present invention will be described below with reference to FIGS. 1A to 7. The receptacle connector shown in FIGS. 1A to 3C (hereinafter, referred to as a receptacle R) is mountable on a circuit board 10 (refer to FIG. 7) of electronic equipment (not shown). It is used as an external interface of the electronic equipment, for connection with a plug connector (hereinafter, referred to as a plug P), for example, as shown in FIG. 4B. The receptacle R includes a shield case 100, and a body 200, and a plurality of contacts 300. The respective elements of the receptacle R will be described in detail below. An insertion direction of the plug P is denoted as "α" in FIGS. 4B to 5B.

The shield case 100 is a sheet of conductive metal plate press-molded into a shape as shown in FIGS. 1A to 3C, 5A, and 5B. The shield case 100 includes a pair of inner walls 110, a bottom plate 120 (first coupling portion), a pair of folded-back portions 130, a pair of outer walls 140, a top plate 150 (second coupling portion), a pair of first and second connecting legs 160*a*, 160*b*, and a pair of holding pieces 170.

Figure 5A:
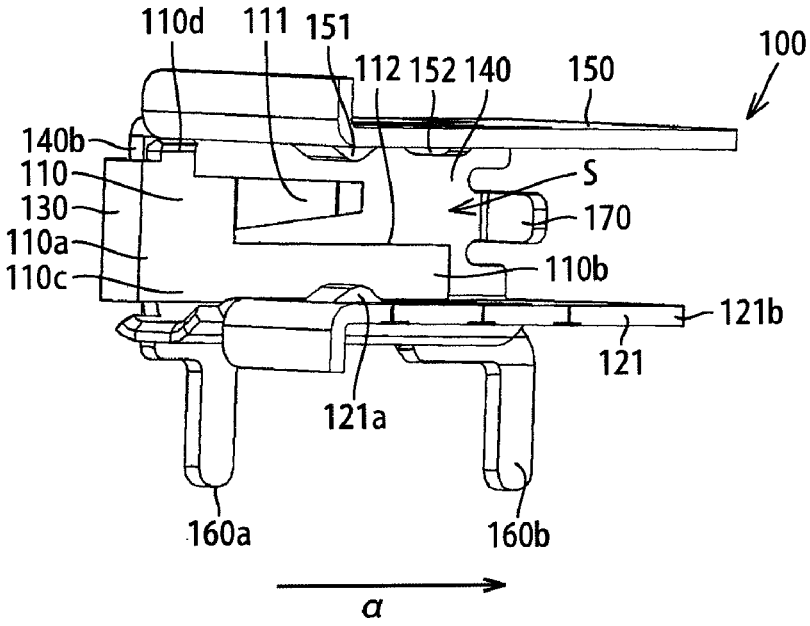
FIG. 5A is a cross-sectional view taken along 5A-5A in FIG. 1A of the shield case of the connector.
Figure 5B:
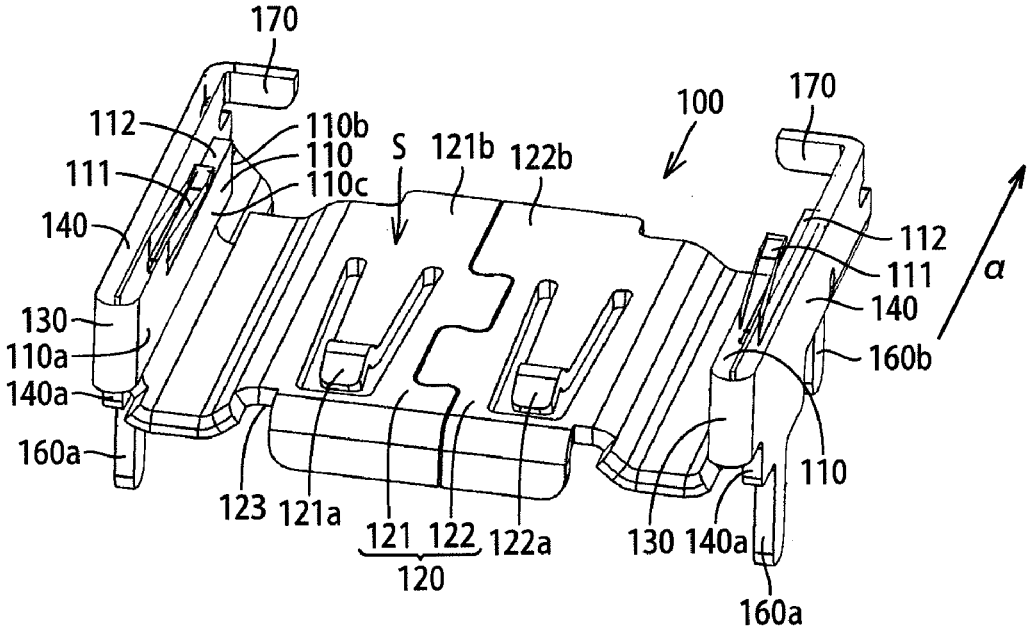
FIG. 5B is a cross-sectional view taken along 5B-5B in FIG. 1A of the shield case of the connector.

The pair of inner walls 110 are oppositely arranged so as to receive a plug P therebetween. Each of the inner walls 110 is provided with an elastic contact piece 111 as shown in FIGS. 5A and 5B. The elastic contact pieces 111, formed by cutting and raising portions of the inner wall 110 inward, extend to the far side in the insertion direction α and are inclined inward. The distal ends of the elastic contact pieces 111 are bent outward. A distance between the distal ends of the elastic contact pieces 111 is slightly smaller than a distance between opposite side surfaces of a shell P1 of the plug P. Moreover, a notch 112 is formed around each of the elastic contact pieces 111 of the inner walls 110. The notch 112 results from cutting around the elastic contact piece 111 of the inner wall 110 in order to cut and raise the elastic contact piece 111. A front end 110*a* on the near side and a rear end 110*b* on the far side in the insertion direction α of each inner wall 110 correspond to a first end and a second end, respectively, in the insertion direction of the inner wall recited in the claims; a lower end 110*c* extending orthogonally to the front end 110*a* and the rear end 110*b* corresponds to a third end; and an upper end 110*d* on the opposite side of the lower end 110*c* corresponds to a fourth end.

The bottom plate 120 has a pair of coupling plates 121, 122 as shown in FIG. 5B. The coupling plate 121 is a generally rectangular plate provided continuously to the near side of the lower end 110*c* of one of the inner walls 110, bent orthogonally to the relevant inner wall 110. The coupling plate 121 has an outer end portion, an inner end portion, and a bent portion provided between the outer end portion and the inner end portion. The coupling plate 122 is a generally rectangular plate provided continuously to the near side of the lower end 110*c* of the other inner wall 110 and bent orthogonally to the relevant inner wall 110. The coupling plate 122 has an outer end portion, an inner end portion, and a bent portion provided between the outer end portion and the inner end portion. The inner end portions of the coupling plates 121, 122, having tabs and corresponding blanks like jigsaw puzzle pieces, are interlocked and swaged. The inner end portions of the coupling plates 121, 122 are thus coupled so that the bottom plate 120 serves to couple between the lower ends 110*c* of the inner walls 110. The bent portions of the coupling plates 121, 122 are bent upward so that lower surfaces of the inner end portions are located higher than upper surfaces of the outer end portions. A depressions 123 thus appears below the inner end portions of the coupling plates 121, 122. The inner end portions of the coupling plates 121, 122 also have lock pieces 121*a*, 122*a*, respectively. The lock pieces 121*a*, 122*a* are formed by cutting and raising portions of the inner end portions, extend to the near side in the insertion direction α, and is inclined upward. The lock pieces 121*a*, 122*a* are to be locked in a pair of lower locking holes of the shell P1 of the plug P received in a receiving hole S1 (to be described). Moreover, fitting projections 121*b*, 122*b* project from rear ends of the coupling plates 121, 122 in the insertion direction α from the inner end portions.

As shown in FIGS. 5A and 5B, the folded-back portions 130 are plates of U shape in plan view, provided continuously to the front ends 110*a* of the inner walls 110 and folded back outward and rearward (i.e., toward the rear end 110*b* side of the inner wall 110). Inner ends of the folded-back portions 130 continue to the front ends 110*a* of the inner walls 110, and outer ends of the folded-back portions 130 continue to front ends of the outer wall 140.

Figure 1B:
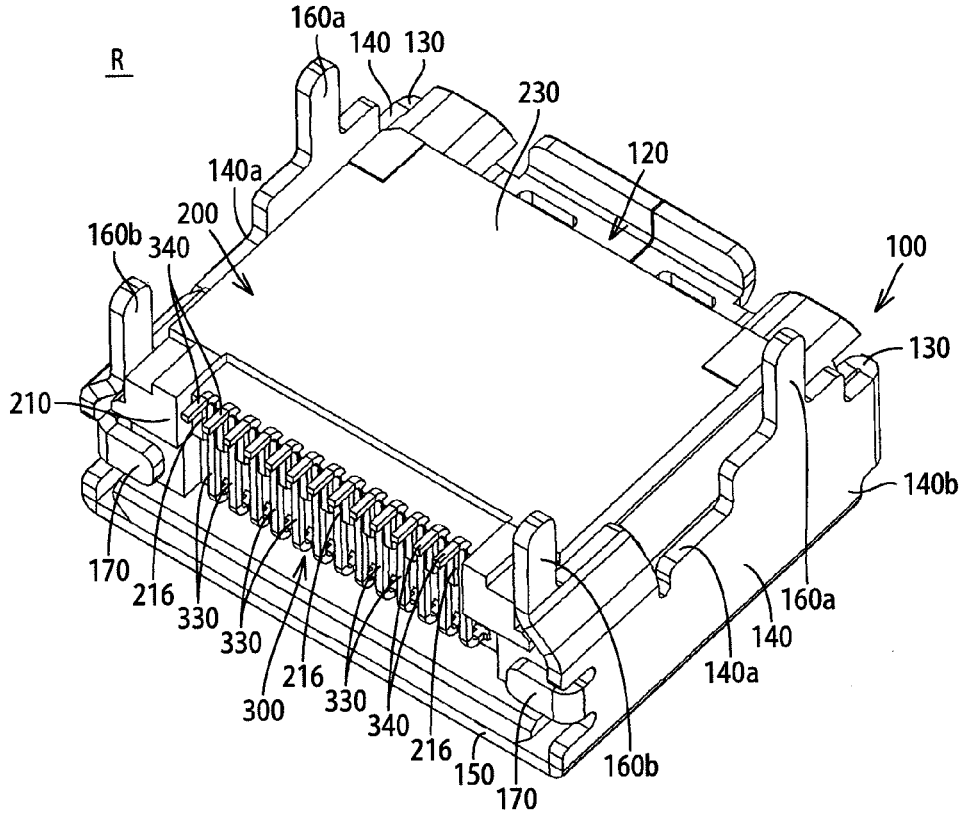
FIG. 1B is a back, bottom, and right side perspective view of the receptacle connector.
Figure 2A:
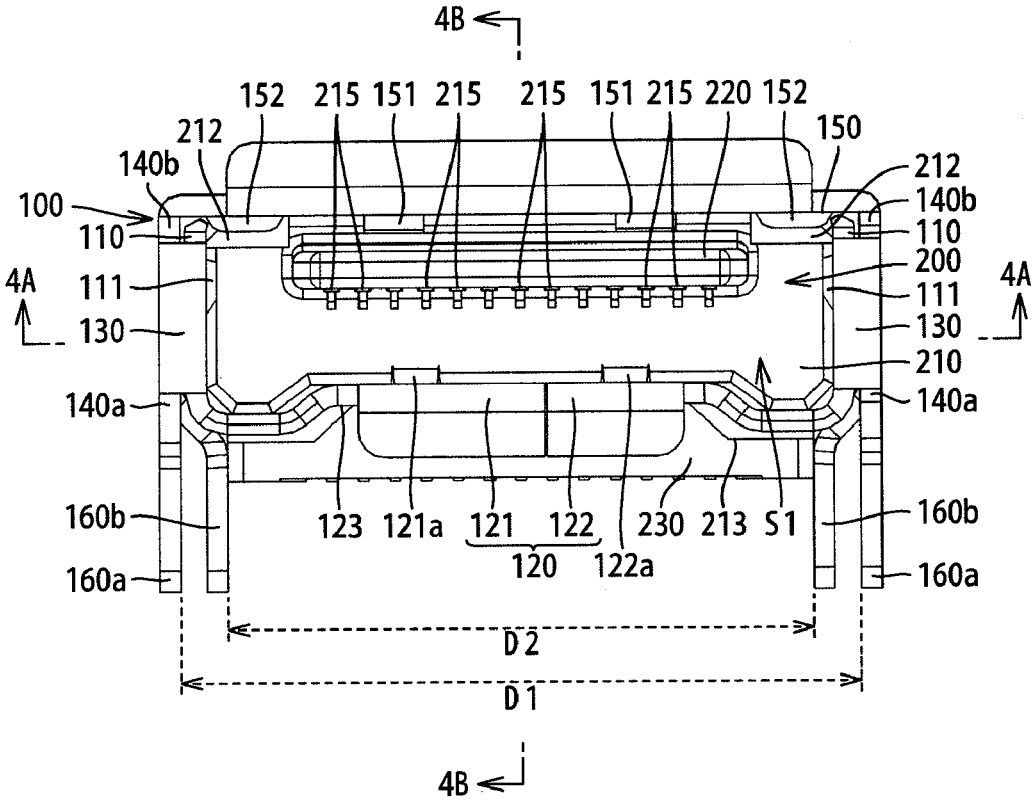
FIG. 2A is a front view of the connector.
Figure 7:
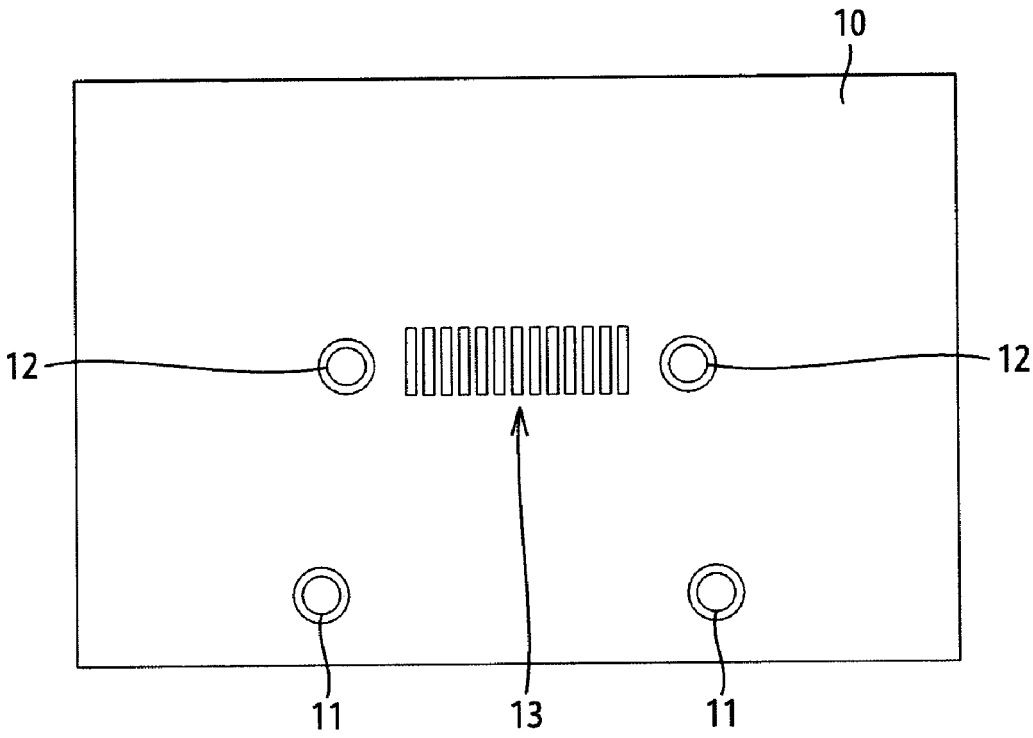
FIG. 7 is a schematic plan view of a circuit board for mounting the connector.

The outer walls 140 are rectangular plates of larger outer dimensions than those of the inner wall 110, as shown in FIGS. 5A and 5B. The outer walls 140 are arranged along and in contact with outer surfaces of the inner walls 110. The outer walls 140 cover the notches 112 of the inner walls 110. The outer walls 140 each have the above-mentioned front end, a rear end, a lower end 140*a* (a first end as recited in the claims, opposed to the third end (i.e., the lower end 110*c*) of the inner wall), and an upper end 140*b* (a second end on the opposite side of the first end). From the lower end 140*a* of each of the outer walls 140, the first connecting leg 160*a* extends downward on the near side in the insertion direction α, and the second connecting leg 160*b* extends downward on the far side in the insertion direction α. The first and second connecting legs 160*a*, 160*b* are piece members adapted to be connected by dip soldering to first and second through-holes 11, 12 of the circuit board 10 as shown in FIG. 7. The shield case 100 is connected to the ground of the circuit board 10 via the first and second through-holes 11, 12. The basal portions of the second connecting legs 160*b* are bent inward. This makes a distance D2 between distal ends of the second connecting legs 160*b* smaller than a distance D1 between distal ends of the first connecting legs 160*a*, as shown in FIG. 2A. The second connecting legs 160*b* are thus located outside of tail portions 340 (to be described) of the contacts 300 and are to be soldered in the vicinity of the tail portions 340, as shown in FIG. 1B. The holding piece 170 are provided at respective rear ends of the outer walls 140. The holding pieces 170 are piece members extending in the insertion direction α and are bent inward at a right angle to abut a rear surface of a main body 210 of the body 200.

Figure 3A:
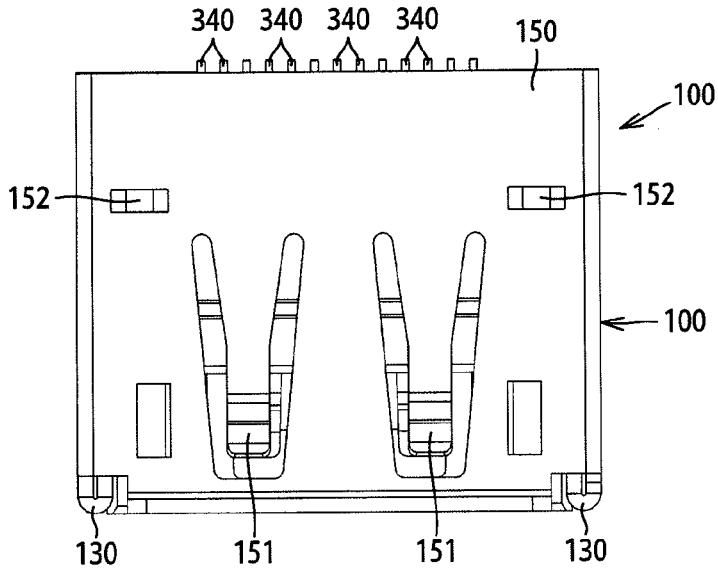
FIG. 3A is a plan view of the connector.
Figure 3B:
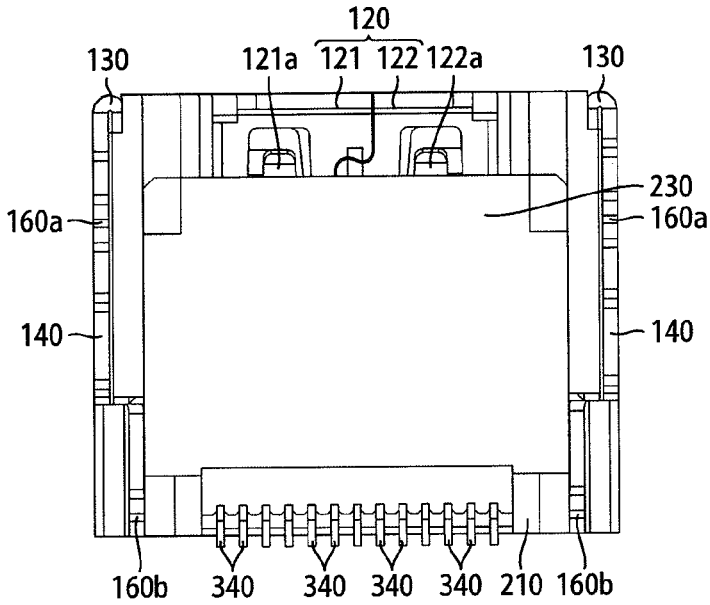
FIG. 3B is a bottom view of the connector.
Figure 3C:
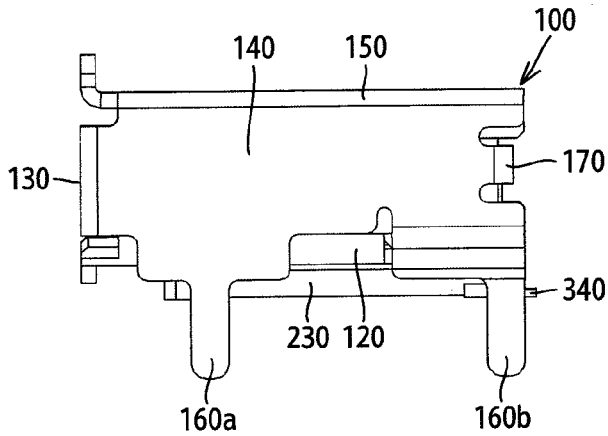
FIG. 3C is a right side view of the connector.

As shown in FIG. 3A, the top plate 150 is a rectangular plate that couples the upper ends 140*b* of the outer walls 140. The top plate 150, the pair of inner walls 110, the pair of outer walls 140, and the bottom plate 120 define an accommodating space S to accommodate the body 200 (refer to FIGS. 5A and 5B). This accommodating space S includes the receiving hole S1, which is a space defined by portions on the near side of the pair of inner walls 110, portions on the near side of the pair of outer walls 140, portions on the near side in the insertion direction α of the bottom plate 120 and the top plate 150, and a front surface of the main body 210 of the body 200 (front surface of the body) (refer to FIGS. 4A and 4B). The receiving hole S1 is adapted to receive the plug P along the insertion direction α. The portion on the near side of the top plate 150 is provided with a pair of lock pieces 151. The lock pieces 151, formed by cutting and raising portions on the near side of the inner wall 110 inward, extend to the near side in the insertion direction α and are inclined downward. The lock pieces 151 are to be locked in a pair of upper locking holes of the shell P1 of the plug P received in the receiving hole S1. Furthermore, the portion on the far side in the insertion direction α of the top plate 150 is provided with a pair of abutting-stop projections 152.

Figure 6A:
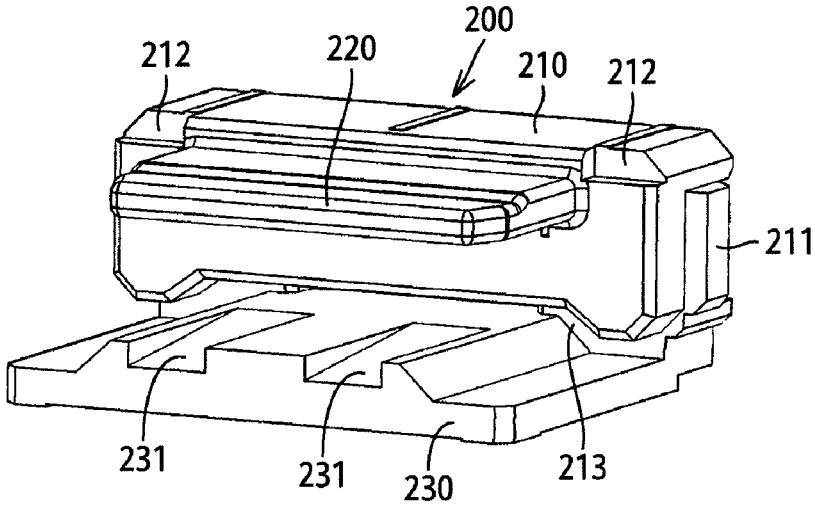
FIG. 6A is a front, plan, and right side perspective view illustrating a body of the connector.
Figure 6B:
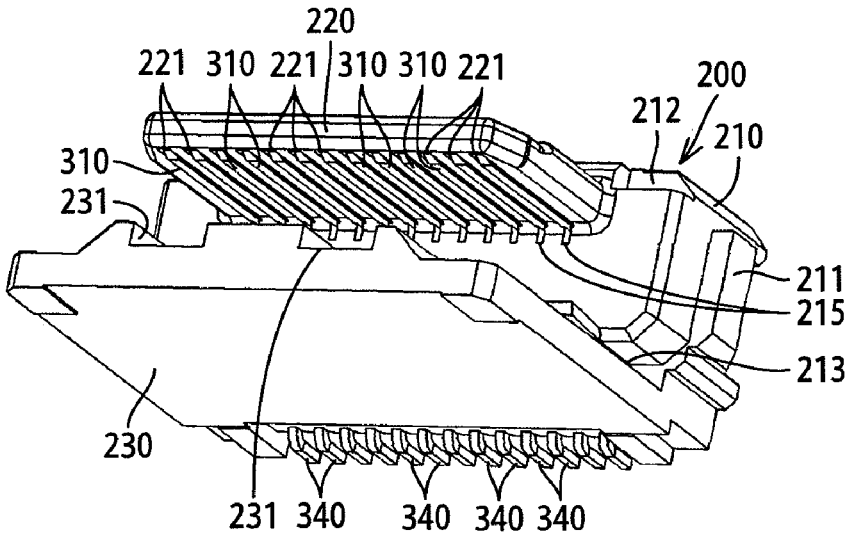
FIG. 6B is a front, bottom, and right side perspective view illustrating the body that holds contacts of the connector.

The body 200 is an injection-molded article made of insulating resin. As shown in FIGS. 6A and 6B, the body 200 has the generally rectangular main body 210, a plate-like projection 220 projecting from a central portion of the front surface of the main body 210, a generally trapezoidal seat 230 projecting from a lower end of the front surface of the main body 210. The main body 210 is accommodated in a space (hereinafter referred to as "back space") on the far side in the insertion direction α of the accommodating space S of the shield case 100. The projection 220 is accommodated in a space on the near side (i.e., the receiving hole S1) in the insertion direction α of the accommodating space S (refer to FIG. 4B). The seat 230 is placed under the bottom plate 120 of the shield case 100. Widthwise side surfaces of the main body 210 are provided with vertically elongated protrusions 211 serving as abutting stops. Upper widthwise end portions of the main body 210 have a pair of depressions 212. The front surface of the main body 210 has a fitting groove 213 above the seat 230. A rectangular fitting depression 214 is formed centrally of a back surface of the fitting groove 213.

Figure 4A:
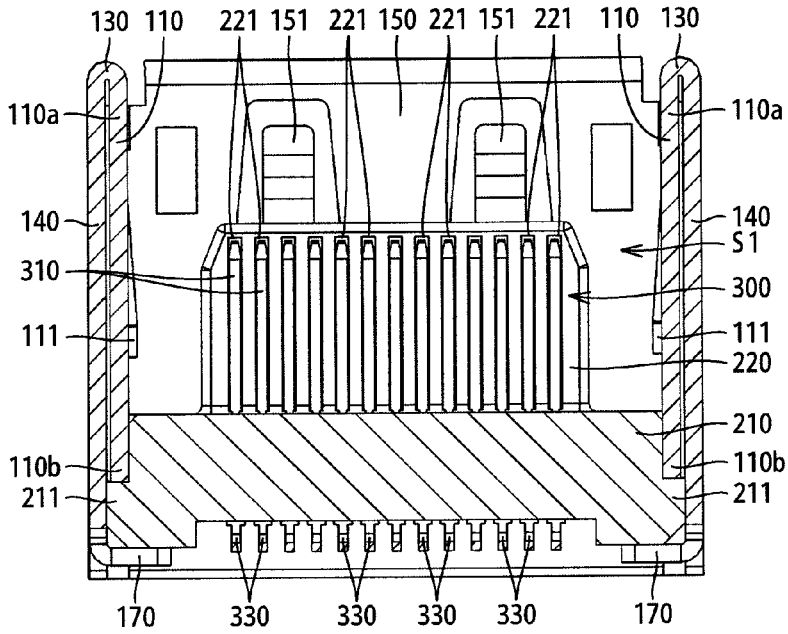
FIG. 4A is a cross-sectional view taken along 4A-4A in FIG. 2A of the connector.
Figure 4B:
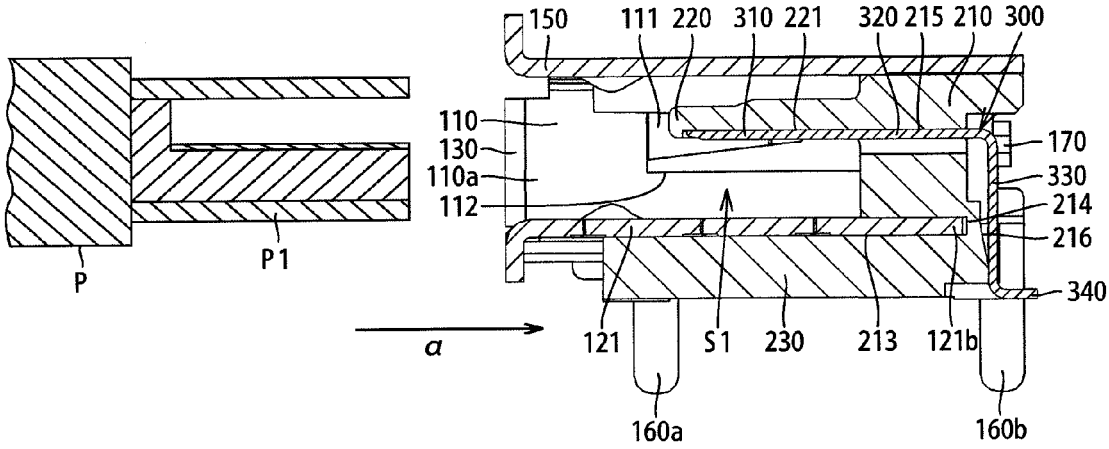
FIG. 4B explanatorily illustrates the connector in a cross-sectional view along 4B-4B in FIG. 2A, together with a mating plug before connection in schematic cross-sectional view.

As shown in FIGS. 4A and 4B, the elongated protrusions 211 abut the rear ends 110*b* of the inner walls 110 of the shield case 100, the depressions 212 fittingly receive the projections 152 of the top plate 150 of the shield case 100, the fitting groove 213 receives a rear end of the bottom plate 120 of the shield case 100, and the fitting depression 214 fittingly receives the fitting projections 121*b*, 122*b* of the bottom plate 120. The rear surface of the main body 210 abuts the pair of holding pieces 170 of the shield case 100. That is, the main body 210 is sandwiched between portions on the near side (namely, the rear ends 110*b* of the inner walls 110, the projections 152 of the top plate 150 and the rear end of the bottom plate 120) and the pair of holding pieces 170 of the shield case 100, while the depressions 212 of the main body 210 fittingly receive the projections 152, and the fitting depression 214 fittingly receives the fitting projections 121*b*, 122*b*, so that the main body 210 is securely placed in the back space of the accommodating space S of the shield case 100.

Figure 2B:
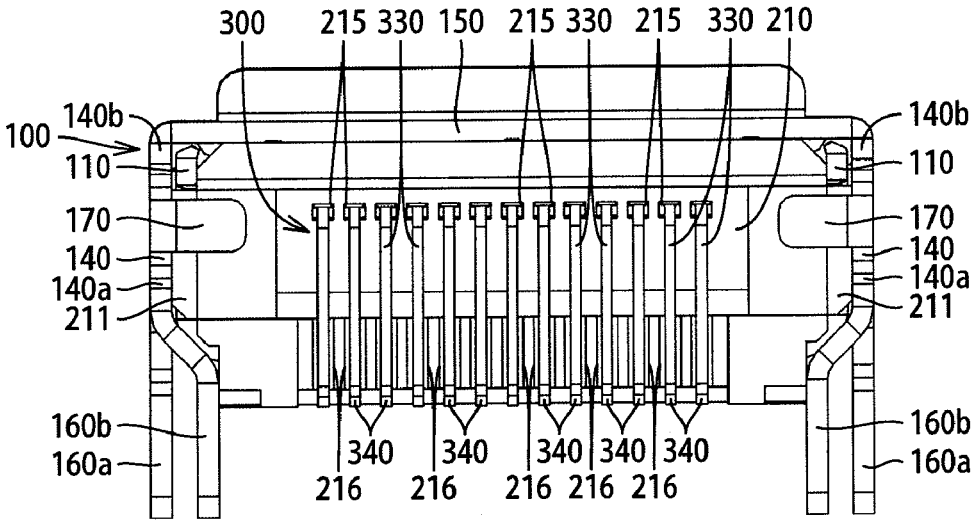
FIG. 2B is a back view of the connector.

A central portion of the main body 210 has a plurality of through-holes 215 passing in the insertion direction α at predetermined widthwise intervals, as shown in FIG. 4B. A lower end of the rear surface of the main body 210 has a plurality of accommodating grooves 216 at the same intervals as those of the through-holes 215, as shown in FIG. 2B. A lower surface of the projection 220 has a plurality of accommodating grooves 221 at the same intervals as those of the trough-holes 215. The accommodating grooves 221 communicate with the through-holes 215 and extend along the insertion direction α.

As shown in FIGS. 6A and 6B, the seat 230 is adapted to be mounted on the circuit board 10 together with the main body 210. The seat 230 has a centrally and upwardly formed projection to be received in the depression 123 of the shield case 100. The projection is provided with a pair of relief depressions 231 at positions corresponding to the lock pieces 121*a*, 122*a* of the bottom plate 120. The relief depressions 231 are adapted to receive the lock pieces 121*a*, 122*a* that have made downward elastic deformation.

The contacts 300 are disposed in the body 200 at widthwise intervals, as shown in FIGS. 4A and 6B. The contacts 300, generally L-shaped conductive metal plates, each have a contact portion 310, a fixed portion 320, a hung portion 330, and a tail portion 340, as shown in FIG. 4B. The fixed portion 320 is a plate slightly wider than the through-hole 215 of the body 200, and it is fixedly press-fitted in one of the through-holes 215 from the rear. The contact portion 310 is an elongated plate continued to a front end in the insertion direction α of the fixed portion 320, and it is received in one of the accommodating grooves 221 of the body 200. A lower surface of the contact portion 310 is exposed from the accommodating groove 221, as shown in FIGS. 4A and 6B. The hung portion 330 is an elongated plate continued from a far end in the insertion direction α of the fixed portion 320, and it is bent substantially orthogonally to the fixed portion 320, as shown in FIG. 4B. A lower end of the hung portion 330 is received in the accommodating groove 216 of the body 200. The tail portion 340 is an elongated plate continued to a lower end of the hung portion 330 and bent substantially orthogonally to the hung portion 330. The tail portions 340 are disposed on the far side in the insertion direction α of the shield case 100, and they are connectable to electrodes 13 of the circuit board 10 by soldering. The contacts 300 are connected to signal lines of the circuit board 10 via the electrodes 13.

The receptacle R is configured as described above and may be assembled in the following steps. First, the insulating resin is injection-molded to form the body 200, and a conductive metal plate is pressed to mould the contacts 300. Thereafter, the contact portions 310 of the contacts 300 are inserted into the through-holes 215 of the body 200 from the rear. The inserted contact portions 310 of the contacts 300 are then moved further into the accommodating grooves 221 of the body 200, the fixed portions 320 are press-fitted in the through-holes 215, and the lower ends of the hung portions 330 are inserted into the accommodating grooves 216. In this manner the contacts 300 are fixed into the body 200.

Thereafter, a conductive metal plate is pressed to mould the shield case 100 with the holding pieces 170 in line with the outer walls 140. The projection 220 of the body 200 is then inserted into the accommodating space S of the shield case 100 from the rear, and the fitting groove 213 of the body 200 receives the rear end of the bottom plate 120 of the shield case 100. At this time, the projections 152 of the top plate 150 of the shield case 100 are fitted in the depressions 212 of the body 200, and the fitting projections 121*b*, 122*b* of the bottom plate 120 are fitted in the fitting depression 214 of the body 200. The projection 220 of the body 200 is thus accommodated in the receiving hole S1 of the shield case 100, and the main body 210 of the body 200 is accommodated in the back space of the accommodating space S. The holding pieces 170 are then bent inward to abut the rear surface of the main body 210. In this manner the body 200 is fixedly positioned inside the accommodating space S of the shield case 100.

The receptacle R assembled in the above manner is then mounted on the circuit board 10. Specifically, the pair of first connecting legs 160*a* and the pair of second connecting legs 160*b* of the receptacle R are inserted into the pair of first through-holes 11 and the pair of second through-holes 12 of the circuit board 10, respectively. Then the main body 210 and the seat 230 of the body 200 of the receptacle R are placed on the circuit board 10, and the tail portions 340 of the contacts 300 are placed on the electrodes 13 of the circuit board 10. In this state, the first and second connecting legs 160*a*, 160*b* are soldered to the first and second through-holes 11, 12, and the tail portions 340 are soldered to the electrodes 13.

The receptacle R is mounted on the circuit board 10 in the above manner and is ready to receive the plug P. The following paragraph describes how to connect the plug P to the receptacle R and how the respective elements of the receptacle R operate during the connection. It should be noted that the plug P has a connection portion on its distal end side that is covered with the rectangular tuboid shell P1 made of conductive metal.

When the connection portion of the plug P is inserted into the receiving hole S1 of the receptacle R, contacts of the plug P come into elastic contact with the respective contact portions 310 of the contacts 300 of the receptacle R. Simultaneously, the lock pieces 121*a*, 122*a* of the receptacle R are locked in the pair of lower locking holes of the shell P1 of the plug P, and the lock pieces 151 are locked in the pair of upper locking holes of the shell P1 of the plug P, so that connection between the plug P and the receptacle R is maintained. Also, distal ends of the pair of elastic contact pieces 111 of the receptacle R come into elastic contact with respective side surfaces of the shell P1 of the plug P. This allows the shell P1 to be electrically connected to the shield case 100 and connected to the ground of the circuit board 10 via the shield case 100. When the lock pieces 121*a*, 122*a* are locked in the lower locking holes of the shell 21 of the plug P, they make downward elastic deformation and are received in the relief depressions 231 of the body 200.

In the above-described receptacle R, the outer walls 140 are arranged along the outer surfaces of the inner walls 110 to reinforce the inner walls 110. Thus, although the inner walls 110 are partly cut and raised to form the elastic contact pieces 111 or the like, the shield case 100 can maintain enough strength. Also, the top plate 150 couples the upper ends 140*b* of the outer walls 140, and the bottom plate 120 couples the lower ends 110*c* of the inner walls 110, further improving the strength (including prying resistance) of the shield case 100. Furthermore, as the outer walls 140 cover the notches 112 of the inner walls 110, partly cutting and raising the inner walls 110 to form the elastic contact pieces 111 or the like will not significantly count against the EMI characteristics of the shield case 100 (i.e. EMI will be favorably reduced).

Further advantageously, the first connecting legs 160*a* are provided on the near side of the outer walls 140 of the shield case 100. Even when the connection portion of the plug P received in the receiving hole S1 applies load on the receptacle R, solder connections between the first connecting legs 160*a* and the circuit board 10 will receive less load, compared with a case where the connecting legs are located on the far side. The second connecting legs 160*b* are additionally provided on the far side of the outer walls 140. Consequently, the receptacle R has better peeling strength with respect to the circuit board 10.

Moreover, the distance D2 between the distal ends of the second connecting legs 160*b* is smaller than the distance D1 between the distal ends of the first connecting legs 160*a*, and the second connecting legs 160*b* are arranged outside the tail portions 340 of the contacts 300. That is, the second connecting legs 160*b* are connected to the circuit board 10 in the vicinity of the tail portions 340 by soldering. Even when the plug P received in the receiving holes S1 is twisted, loads applied to the solder connections connecting the tail portions 340 can be alleviated. Also, the second connecting legs 160*b* are soldered to the circuit board on inner sides than the first connecting legs 160*a*, improving the peeling strength of the shield case 100 itself with the circuit board (particularly strength in the width direction of the shield case 100).

The above-described receptacle R and the shield case 100 are not limited to the above-described embodiment. They may be modified in design within the scope of claims, as detailed below.

The outer walls may abut the inner walls as in the above-described embodiment, but the outer walls only need to be arranged along the inner walls for reinforcement of the inner walls. For example, the outer walls may be arranged with a slight clearance to the inner walls such that the inner walls, when warped, may abut the outer walls and be supported by the outer walls. The inner walls according to the above-described embodiment are formed with the notches resulting from cutting and raising the elastic contact pieces, but the inner walls may have openings or the like in place of the notches. Also in the case where the openings are formed in the inner walls, the shield case can maintain enough strength and have favorable EMI characteristics because the outer walls are disposed along the inner walls.

The folded-back portions may be provided continuously to the front ends of the inner walls and are folded back to the rear end side as in the above-described embodiment, but they may be provided continuously to the rear ends of the inner walls and are folded back to the front end side. In other words, the first ends in the insertion direction of the inner walls may be the rear ends of the inner walls, and the second ends of the inner walls may be the front ends thereof.

The first and second connecting legs may extend downward from the lower ends of the outer walls as in the above-described embodiment. They may be modified such that only the first connecting legs or the second connecting legs are provided at the lower ends of the outer walls, or that the first and second connecting legs are omitted. The first and second connecting legs need not extend downward from the lower ends of the outer walls, but they may be formed by cutting and raising portions of the outer walls (e.g., portions other than the portions covering the openings or the notches of the inner walls). Furthermore, the first and second connecting legs may be piece members adapted for dip soldering, but they may be legs for surface mount technology (SMT). Particularly, the legs for SMT may be bent substantially orthogonally to the outer walls and connectable to electrodes on a circuit board. The tail portions of the contacts may be legs for dip soldering, e.g. formed in line with the hung portions 330 so as to be connectable to through-holes on a circuit board.

Figure 8:
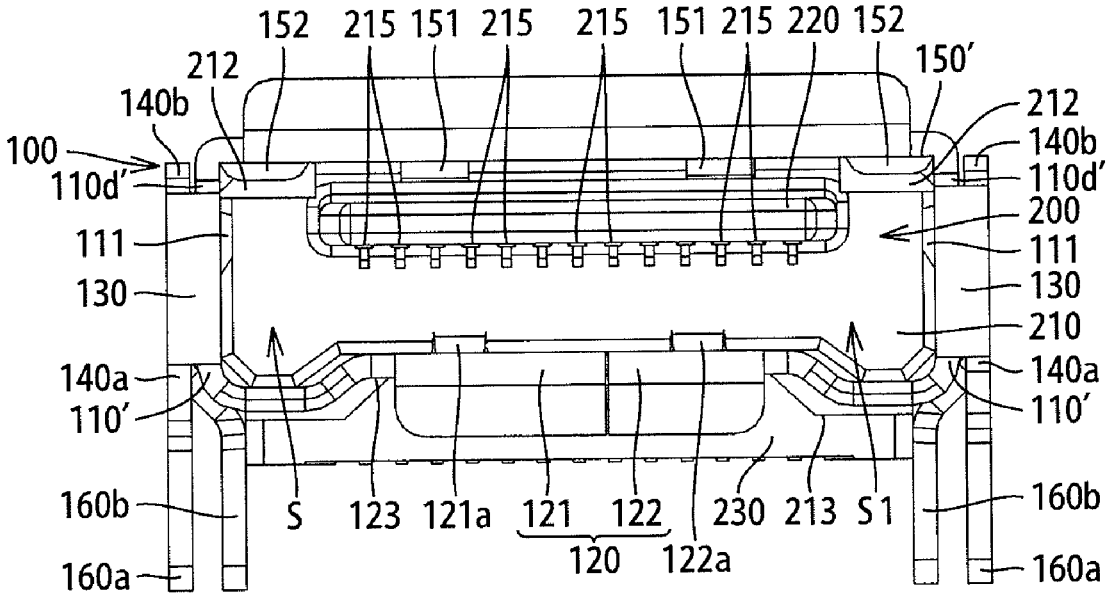
FIG. 8 is a schematic front view of a modified connector.

The top plate of the invention is not limited to one adapted to couple the upper ends of the outer walls. One example of modification is illustrated in FIG. 8, wherein a top plate 150' couples upper ends 110*d*' of inner walls 110'. In this case, the top plate 150', the inner walls 110', outer walls 140, and the bottom plate 120 may define the accommodating space S; and the top plate 150', the inner walls 110', the outer walls 140, the bottom plate 120, and the front surface of the body 200 may define the receiving hole S1. The accommodating space may be defined only with the top plate, the inner walls, and the bottom plate. The receiving hole may also be defined only with the top plate, the inner walls, the bottom plate, and the front surface of the body. Specifically, if the notches or the openings of the inner walls are small in outer dimensions, the accommodating space and the receiving hole can be made without using the outer walls. The bottom plate may couple the lower ends of the inner walls as in the above-described embodiment, or alternatively the bottom plate may couple the lower ends of the outer walls. Moreover, the present invention is not limited to a configuration as in the above-described embodiment where the bottom plate is made up of the two coupling plates with their inner end portions fittingly engaged with each other. For example, the top plate in place of the bottom plate may be made up of two coupling plates with inner end portions to be coupled with each other. In this case, the bottom plate may be a single plate.

In the above-described embodiment, the lock pieces are provided in the top plate and the bottom plate. However, a lock piece or lock pieces may be provided only in one of the top plate and the bottom plate, or the top plate and the bottom plate may be formed with no lock pieces at all.

The receptacle may have a plurality of contacts of one type as in the above-described embodiment, or it may have two or more types of contacts. The body of the above-described embodiment includes the body portion, the projection, and the seat. However, the body can be modified to be of any shape that is adapted to be accommodated in the accommodating space of the shield case and to hold contacts.

The materials, shapes, numbers, dimensions, arrangements, etc. of the respective elements of the shield case, the body, and the contacts have been described by way of example only, and they may be modified in design in any manner as long as they provide similar functions. The present invention is not limited to receptacle connectors but may be applicable to plug connectors. In the case where the present invention is applied to a plug connector, for example, a cable or cables may be connected to an end of a circuit board on which a shield case of the connector is mounted, or may be connected to the tail portions of the connector.

REFERENCE SIGNS LIST

R receptacle
100 shield case
110 inner wall
110*a* front end (first end)
110*b* rear end (second end)
110*c* lower end (third end)
110*d* upper end (fourth end)
111 elastic contact piece
112 notch
120 bottom plate (first coupling portion)
121*a*, 122*a* lock piece
130 folded-back portion
140 outer wall
140*a* lower end (first end)
140*b* upper end (second end)
150 top plate (second coupling portion)
151 lock piece
152 projection
160*a* first connecting leg
160*b* second connecting leg
170 holding piece
S accommodating space
S1 receiving hole
200 body
210 body portion
220 projection
230 seat
300 contact
310 contact portion
320 fixed portion
330 hung portion
340 tail portion
α insertion direction
10 circuit board
11, 12 first and second through-holes
13 electrode
P plug
P1 shell

The invention claimed is:

1. A shield case comprising:

a pair of inner walls, being opposed to each other and adapted to receive a mating connector therebetween, the pair of inner walls each including first and second ends in an insertion direction of the mating connector;

a pair of elastic contact pieces, each formed by cutting and inwardly raising a portion of each of the inner walls;

openings or notches, formed in order to cut and raise the elastic contact pieces in the inner walls;

a pair of folded-back portions, provided continuously to the first ends of the inner wails and folded back to a second end side of the inner walls; and a pair of outer walls, provided continuously to the folded-back portions, arranged along outer surfaces of the inner walls, the outer walls arranged along and in contact with outer surfaces of the inner walls, and covering the openings or the notches.

2. A shield case comprising a pair of inner walls, being opposed to each other and adapted to receive a mating connector therebetween, the pair of inner walls each including first and second ends in an insertion direction of the mating connector;

a pair of elastic contact pieces, each formed by cutting and inwardly raising a portion of each of the inner walls;

openings or notches, formed in order to cut and raise the elastic contact pieces in the inner walls;

a pair of folded-back portions, provided continuously to the first ends of the inner walls and folded back to a second end side of the inner walls;

pair of outer walls, provided continuously to the folded-back portions, arranged along Outer surfaces of the inner walls, and covering the openings or the notches; and first and second coupling portions, wherein each of the inner walls further includes a third end, extending at an angle to the first and second ends, each of the outer walls has a first end and a second end that are opposite each other, the first end facing the third end of each of the inner walls, the first coupling portion joins the third ends of the inner walls, the second coupling portion joins the second ends of the outer walls, and at least the inner walls, the first coupling portion, and the second coupling portion define an accommodating space.

3. The shield case according to claim 2, further comprising a pair of first connecting legs provided on a near side in the insertion direction of the outer walls.

4. The shield case according to claim 3, further comprising a pair of second connecting legs provided on a far side in the insertion direction of the outer wails.

5. A connector comprising: the shield case according to claim 4; an insulating body accommodated in the accommodating space of the shield case; and a plurality of contacts arrayed in the body, wherein the contacts each include a tail portion disposed on the far side in the insertion direction of the shield case, and a distance between the second connecting legs is smaller than a distance between the first connecting legs.

6. Electronic equipment comprising the connector according to claim 5 as an external interface thereof.

7. The shield case according to claim 2, further comprising a lock piece, provided in at least one of the first and second coupling portions, and adapted to lock a mating connector received in the accommodating space.

8. A connector comprising:

the shield case according to claim 2;

an insulating body accommodated in the accommodating space of the shield case; and a plurality of contacts arrayed in the body.

9. Electronic equipment comprising the connector according to claim 8 as an external interface thereof.

10. A shield case comprising:

a pair of inner walls, being opposed to each other and adapted to receive a mating connector therebetween, the pair of inner walls each including first and second ends in an insertion direction of the mating connector;

a pair of elastic contact pieces, each formed by cutting and inwardly raising a portion of each of the inner walls;

openings or notches, formed in order to cut and raise the elastic contact pieces in the inner walls;

a pair of folded-back portions, provided continuously the first ends of the inner walls and folded back to a second end side of the inner walls;

a pair of outer walls, provided continuously to the folded-back portions, arranged along outer surfaces of the inner walls, and covering the openings or the notches; and first and second coupling portions, wherein each of the inner walls further includes a third end extending at an angle to the first and second ends, and a fourth end on an opposite side of the third end, the first coupling portion is adapted to join the third ends of the inner walls, the second coupling portion is adapted to join the fourth ends of the inner walls, and at least the inner walls, the first coupling portion, and the second coupling portion define an accommodating space.

11. The shield ease according to claim 10, further comprising a pair of first connecting legs provided on a near side in the insertion direction of the outer walls.

12. The shield case according to claim 11, further comprising a pair of second connecting legs provided on a far side in the insertion direction of the outer walls.

13. A. connector comprising:

the shield case according to claim 12;

an insulating body accommodated in the accommodating space of the shield case; and a plurality of contacts arrayed in the body, wherein the contacts each include a tail portion disposed on the far side in the insertion direction of the shield case, and a distance between the second connecting legs is smaller than a distance between the first connecting legs.

14. Electronic equipment comprising the connector according to claim 13 as an external interface thereof.

* * * * *